US005557059A

United States Patent [19]

Warren et al.

[11] Patent Number: 5,557,059

[45] Date of Patent: Sep. 17, 1996

[54] TUBELESS CASED TELESCOPED AMMUNITION

[75] Inventors: John B. Warren, Plymouth, Minn.; James Q. Talley, Burlington, Vt.

[73] Assignee: Alliant Techsystems Inc., Hopkins, Minn.

[21] Appl. No.: 421,297

[22] Filed: Apr. 13, 1995

Related U.S. Application Data

[63] Continuation of Ser. No. 203,777, Feb. 28, 1994, abandoned.

[51] Int. Cl.[6] ..... F42B 5/045

[52] U.S. Cl. ..... 102/434; 102/290; 102/443

[58] Field of Search ..... 102/289, 290, 102/430, 431, 433, 434, 443, 464, 469, 470, 700

[56] References Cited

U.S. PATENT DOCUMENTS

| | | | |
|---|---|---|---|
| 3,626,851 | 12/1971 | Ruth | 102/433 |
| 3,628,456 | 12/1971 | Harrell . | |
| 4,062,709 | 12/1977 | Castaneda et al. | 149/19.3 |
| 4,197,801 | 4/1980 | LaFever et al. | 102/434 |
| 4,282,813 | 8/1981 | Sterbutzel . | |
| 4,335,657 | 6/1982 | Bains | 102/433 |
| 4,604,954 | 8/1986 | Clarke et al. | 102/434 |
| 4,802,415 | 2/1989 | Clarke et al. | 102/434 |
| 4,858,533 | 8/1989 | Warren . | |
| 5,042,388 | 8/1991 | Warren et al. . | |
| 5,048,423 | 9/1991 | Garrett | 102/434 |
| 5,063,852 | 11/1991 | Warren . | |
| 5,147,978 | 9/1992 | Northrup et al. . | |

*Primary Examiner*—Harold J. Tudor
*Attorney, Agent, or Firm*—Vidas, Arrett & Steinkraus, P.A.

[57] ABSTRACT

A tubeless cased telescoped ammunition is disclosed. The ammunition is ignited and a sequenced ignition is achieved. The ammunition includes a sealing coating for delaying ignition of the main propellant. A sealing ring may also be used to sequence and delay the ignition.

10 Claims, 2 Drawing Sheets

TUBELESS CASED TELESCOPED AMMUNITION

This is a continuation of application Ser. No. 08/203,777 filed on Feb. 28, 1994 now abandoned.

FIELD OF THE INVENTION

This invention relates to cased telescoped ammunition and more particularly, to a "tubeless" cased telescoped ammunition cartridge case.

BACKGROUND OF THE INVENTION

Cased telescoped ammunition is under consideration for use in ground vehicle, ship and aircraft mounted guns. The projectile is completely enclosed, or telescoped, within the cartridge case and surrounded by consolidated propellant, therefore reducing the volume required for a gun, ammunition storage and feed mechanism or gun system using such ammunition by a significant amount compared with equivalent gun systems using conventionally shaped rounds. The cartridge case of cased telescoped ammunition allows for a simpler, more reliable and more compact gun system with a higher rate of fire.

In cased telescoped ammunition, the projectile is accelerated initially by a booster charge to close, or to obturate, the barrel of the gun before the main propellant charge is fully ignited and to mitigate the peak chamber pressure. A control tube or core tube has been employed in the past to control the initial movement of the projectile. A booster charge may be located in the control tube and is separated by the tube from the main propelling charge. The booster charge is placed aft of the projectile. Main charge ignition does not occur until the advancing projectile clears the tube or exposes or unblocks ignition ports in the wall of the control tube which permits products of the burning booster charge to ignite the main charge. Ignition of the main charge is controlled by the position of the projectile. Main propellant ignition occurs when the projectile is at a known and reproducible location in the round and has moved toward the barrel of the gun from which it is being fired. There should be minimal venting, blow-by, or pressure leakage of the gases produced by the ignited propellant as the projectile accelerates down the gun barrel. An example of a cased telescoped round is disclosed in U.S. Pat. No. 4,858,533 to Warren, which is hereby incorporated by reference, and teaches a cased telescope ammunition round with a full caliber core tube each end of which is respectively connected to the front and rear seals of the cylindrical casing of the round with a fin stabilized penetrator and its sabot positioned within the control tube prior to firing.

U.S. Pat. No. 5,063,852 to Warren, which is hereby incorporated by reference, teaches a cased telescoped ammunition round for a fin stabilized penetrator projectile. The cylindrical casing has a rear seal closing the rear end of the casing and a front seal secured to the front end of the casing. A tapered full caliber control tube is secured to the front seal of the casing. The thickness of the side walls of the control tube increases, or the side walls are tapered, from the rear end to the forward end.

U.S. Pat. No. 5,042,388 to Warren et al., which is hereby incorporated by reference, teaches a cased telescoped ammunition with a perforated forward control tube, in which the main propellant gas and flame front ignites the propellant surrounding the tube through the control tube perforations after the obturator passes the perforations. Seals form annular segments of consolidated propellant surrounding the tube separated from each other and the main propellant charge. These seals limit the ignition path of the propellant surrounding the tube to the control tube perforations or ports which have been passed by the obturator.

The dimensions of the casing of cased telescoped ammunition rounds fired by a given type gun system are fixed. The dimensions of the projectile are determined and therefore, the space available for the propellant and other necessary parts is limited. To maximize the performance of a projectile there is a need to maximize the amount of propellant contained within each round by increasing the space available for propellant without reducing the reliability of the gun system while maintaining consistent performance of each round as fired.

Further, it is advantageous to reduce the weight of the round for ease of use by eliminating unnecessary parts of the ammunition but while maintaining high performance achieved with a sequenced ignition. The elimination of parts also leads to a reduction in cost of the round and simplification of the round leads to a better performing round of ammunition.

SUMMARY OF THE INVENTION

An object of the invention is to provide a cased telescoped ammunition round which employs a sequenced ignition without the use of a control or core tube. As noted above, current designs of cased telescoped ammunition use some form of control tube to retain the projectile in the cartridge case and to delay the ignition of the main charge until the projectile has acquired a certain velocity and position toward the barrel. The control tube sequences the ignition, limiting peak chamber pressure and preventing loss of burning propellant and gas ahead of the projectile. Control tubes add complexity, cost, and weight.

The present invention utilizes a sealing ring between aft and forward charges of consolidated propellant and delays ignition of the aft charge by application of a thin layer of an elastomer or ignition delay surface treatment over its inner diameter and rear face. In this manner, the ignition is sequenced, the advantages of a control tube are maintained but the weight and cost of a control tube are eliminated.

The invention includes a cased telescoped ammunition round, including a case, a projectile carried in the case such that a space is defined peripheral and aft of the projectile, a booster charge located in the space aft of the projectile, a first propellant segment located in the peripheral space between the case and the projectile, the first propellant segment having an inner surface, and ignition delay means associated with the inner surface of the first propellant segment, whereby when the booster charge is ignited the ignition of the first propellant segment is delayed until the projectile moves a predetermined distance.

Another embodiment of the invention includes a cased telescoped ammunition round, comprising, a case, a projectile carried in the case such that a space is defined peripheral and aft of the projectile, a booster charge in the aft space of the projectile, a first propellant segment located within the peripheral space between the case and the projectile, a second propellant segment located within the peripheral space between the case and the projectile and forward of the first propellant segment, and sealing means located between the first and second propellant segments for sealing the first propellant segment from the second, whereby when the booster charge is ignited the gas and flame front generated ignites the first propellant segment and the sealing means delays the ignition of the second propellant segment until the projectile has moved a predetermined distance.

Yet another embodiment of the invention includes a cased telescoped ammunition, comprising, an outer casing having an aft and a forward portion, a projectile located within the casing and defining a space between the casing and the projectile and aft of the projectile, a booster charge in the aft space of the projectile, a first propellant segment located proximate the aft portion of the casing and positioned within the space between the casing and the projectile and having an inner surface, a second propellant segment located proximate the forward portion of the casing and positioned within the space between the casing and the projectile, sealing means located between the first and second propellant segments for sealing the first propellant segment from the second propellant segment; and ignition delay means associated with the inner surface of the first propellant segment whereby the ignition of the first propellant segment is delayed until the ignition delay material is burned and the ignition of the second propellant segment is delayed until the projectile moves beyond a predetermined point in the case.

These and other advantages and features which characterize the invention are pointed out with particularity in the claims annexed hereto and forming a further part hereof. However, for a better understanding of the invention, its advantages and objects obtained by its use, reference should be made to the drawings which form a further part hereof, and the accompanying descriptive matter, in which there is illustrated and described a preferred embodiment of the invention.

BRIEF DESCRIPTION OF THE DRAWINGS

In the drawings, wherein like reference numerals represent like parts throughout the several views.

DETAILED DESCRIPTION OF THE INVENTION

While this invention may be embodied in many different forms, there are described in detail herein specific preferred embodiments of the invention. This description is an exemplification of the principles of the invention and is not intended to limit the invention to the particular embodiments illustrated.

Figure 1:
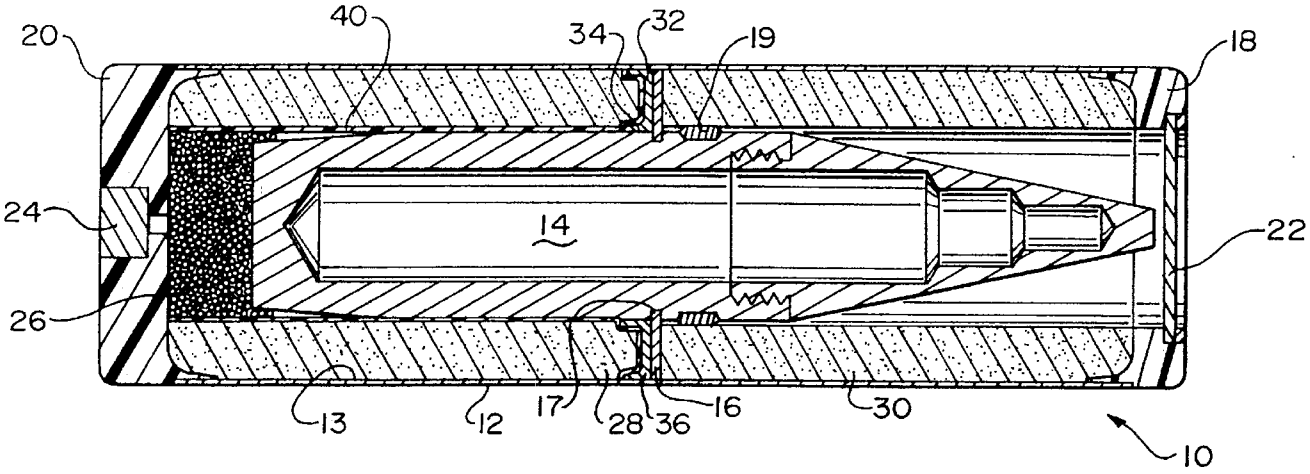
FIG. 1 illustrates a side elevational view of the invention.

Referring to FIG. 1, there is shown a cased telescoped ammunition round 10. The round 10 includes a case 12. The case 12 is generally cylindrical and may be made of composite material such as glass fiber and epoxy or other materials such as metal, for example, high strength steel. The case 12 houses a projectile 14. The projectile 14 may be of the class of projectiles for ground vehicle, shipboard, aircraft systems or any other system which utilizes cased telescoped ammunition. As is illustrated, the projectile 14 is generally placed such that the longitudinal axis of the projectile 14 is generally aligned with the longitudinal axis of the case 12. Space is provided between the case 12 and the projectile 14 and is generally filled with propellant, as will be described below. Although not shown, it should be understood that a fin stabilized projectile could be used with the invention.

The projectile 14 is held within the case 12 by means of a retention ring 16. The retention ring 16 fits within a groove 17 formed in the projectile 14 and is generally an annular ring in the preferred embodiment. As will be described in further detail below, the retention ring 16 fits between two portions 28 and 30 of propellant and is received by the case 12. The retention ring 16 is of a size so that it abuts the inner side or wall 13 of the case 12. The retention ring 16 is made of nitrocellulose material in the preferred embodiment. Those skilled in the art will understand that a combustible material may be utilized but, if not necessary or desired, a material may be utilized which is expelled from the case 12 after ignition of propellant allows the projectile 14 to pass through the cartridge case 12.

The projectile 14 further includes a rotating band 19 in the preferred embodiment. The rotating band 19 prevents any venting or blow-by when the ammunition is fired. The band 19 provides a seal between the projectile 14 and the case 12. As one skilled in the art knows, the rotating band also transfers torque to the projectile in the barrel. It should be understood that the seal may be of a different type or configuration depending on the application and the projectile. For example, an obturating band may be utilized in some applications.

The ammunition 10 further includes a forward seal 18 and a rear seal 20. These seals 18 and 20 are connected to each of the rear and forward portions of the case 12. The seals 18 and 20 are made of a plastic such as polycarbonate in the preferred embodiment. One skilled in the art will understand that the seals 18 and 20 may be made of steel, aluminum or other suitable material. The material chosen depends on the application desired. The seals 18 and 20 are utilized to prevent propellant gas from escaping into the gun when firing the gun. These seals 18 and 20 in conjunction with adjacent components also seal the projectile 14 and propelling charge from the environment and provide for safe handling of the round before firing.

An environmental seal 22 is connected to the forward seal 18. In the preferred embodiment, this seal 22 is made of a combustible material. This seal 22 prevents exposure of the projectile to the environment. In this manner, the propellant is kept dry and any dirt or debris from the environment is not allowed to enter the round 10. The seal 22 may be made of a noncombustible material such as plastic, if desired.

The ammunition round 10 further includes a primer 24 for igniting the ammunition. The primer 24 is well known to those skilled in the art. The primer 24 is located within the rear seal 20 of the round 10. The primer 24 is cooperatively connected to a booster charge 26. The booster charge 26 is located aft of the projectile 14 in the space formed between the rear portion of the case 12 and the aft end of the projectile 14. The booster charge 26 is granular propellant in the preferred embodiment although one skilled in the art will understand that any suitable propellant may be utilized.

The preferred embodiment of the invention includes a first or aft propellant grain or segment 28. The first propellant grain 28 is positioned in the space created between the case 12 and projectile 14 and forward of the rear seal 20. The propellant grain 28 is consolidated propellant in the preferred embodiment.

The round 10 also includes a second or forward propellant grain or segment 30 located in the space between the case 12 and projectile 14 and forward of the first propellant 28. The propellant grain 30 is consolidated propellant grain in the preferred embodiment. Both the first 28 and second 30 propellant segments are shaped in a manner which allows the projectile 14 to move on an axial path through the case 12. In the preferred embodiment, these propellant segments 28 and 30 constitute the main charge of the round 10. It should be understood that there may be any number of desired propellant segments or grains. As mentioned above, the retention ring 16 is located between the first 28 and second 30 propellant grain in the preferred embodiment. One skilled in the art will understand that the retention ring may be located where desired for various applications and combinations of propellants, segments and materials.

The invention includes a propellant sealing ring 32. This ring 32 seals the first propellant segment 28 from the second propellant segment 30. As will be described in further detail below, the ring 32 creates a delay in the ignition of the second propellant grain 30 so that the projectile 14 may move to a desired position in the cartridge case 12 before the second propellant grain 30 is ignited. In this manner, no gas or flame may move ahead of the projectile 14 into the gun system. One skilled in the art will recognize that more than one sealing ring may be utilized with any number of propellant segments depending on the desired application and result.

The ring 32 is generally annular and abuts the inner wall 13 of the case 12. As is shown in FIG. 1, the ring 32 includes flanges 34 and 36. The flanges 34 and 36 effect a dynamic seal. The pressure of the gas and flame front cause the ring to tighten and the flanges 34 and 36 form to the projectile 14 and inner wall 13 of the case 12, respectively. The desired seal is thus formed. The seal 32 is made of nitrocellulose in the preferred embodiment. Any suitable combustible material may be utilized. RTV (room temperature vulcanizing) silicone may also be used. In some applications such as for ground vehicle gun systems, a non-combustible material may be utilized. If the seal 32 is of a non-combustible material, it is expelled from the case 12 after the projectile 14 has moved out of the case.

The preferred embodiment also includes an ignition delay surface treatment 40. The treatment 40 is a surface layer or coating of RTV (room temperature vulcanizing) silicone. In the preferred embodiment, the treatment or layer 40 is Dow Corning type 3110 RTV. The ignition delay surface 40 is applied to the inner surface and forward face of the first propellant 28, as shown in FIG. 1. The delay means comprises a surface treatment that is applied as a liquid by dipping, spraying, painting or otherwise applying to the propellant. It should be understood that the treatment 40 may include any number of suitable materials or coatings and that the propellant segment may be coated on any of one or more surfaces. Any other means that could be associated with delay of ignition may be utilized.

The ignition delay surface treatment 40 delays the ignition of the first propellant 28 so that the ignition of the booster charge 26 may move the projectile 14 a predetermined point out of the casing so that the first propellant segment 28 is not ignited until desired. Therefore, there is a space created for the propellant to burn under lower pressure conditions and there is no escape of gas or flame past the projectile 14 into the gun system and a sequenced ignition is achieved.

Figure 2A:
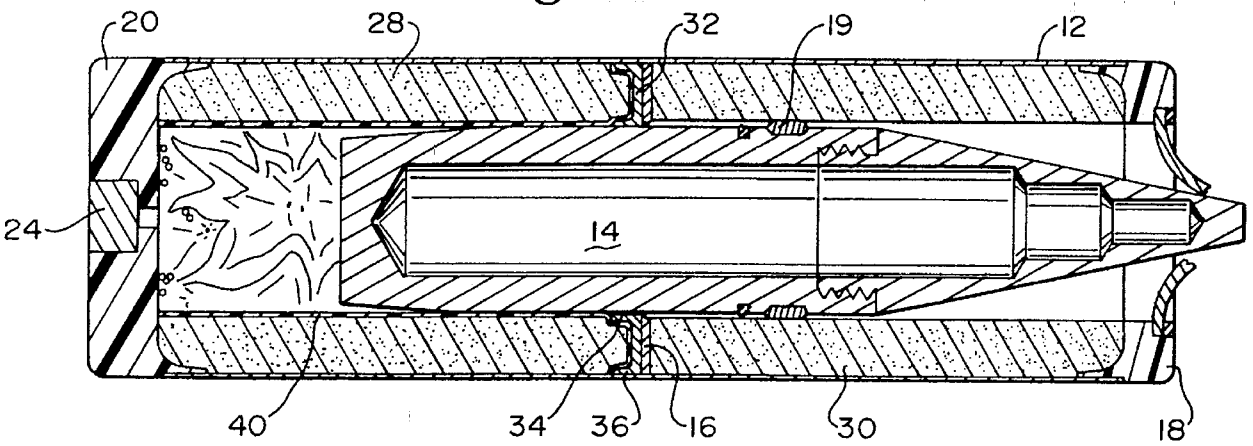
FIGS. 2*a*–2*c* illustrate the sequential ignition of propellant as the projectile moves within the cartridge case.
Figure 2B:
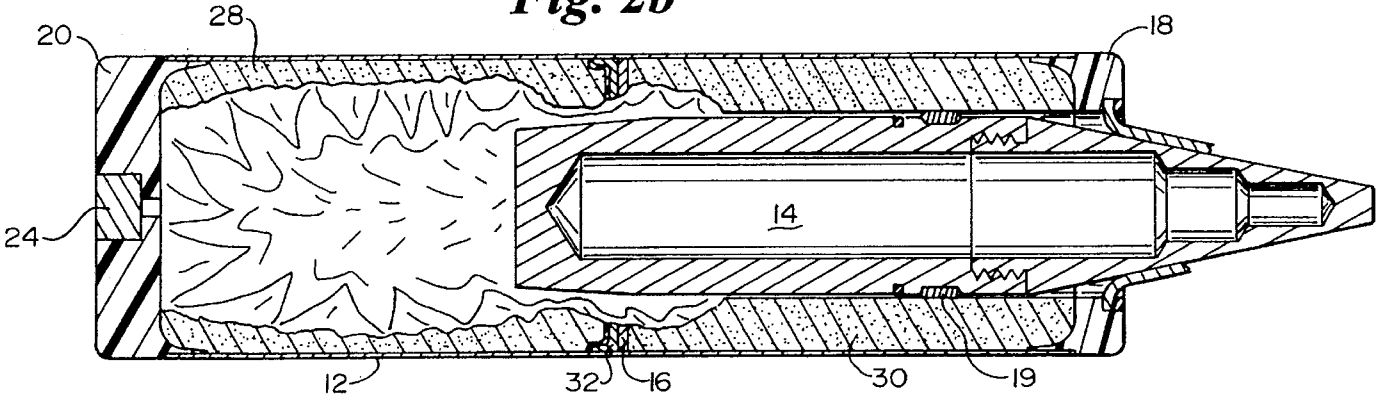
Figure 2C:
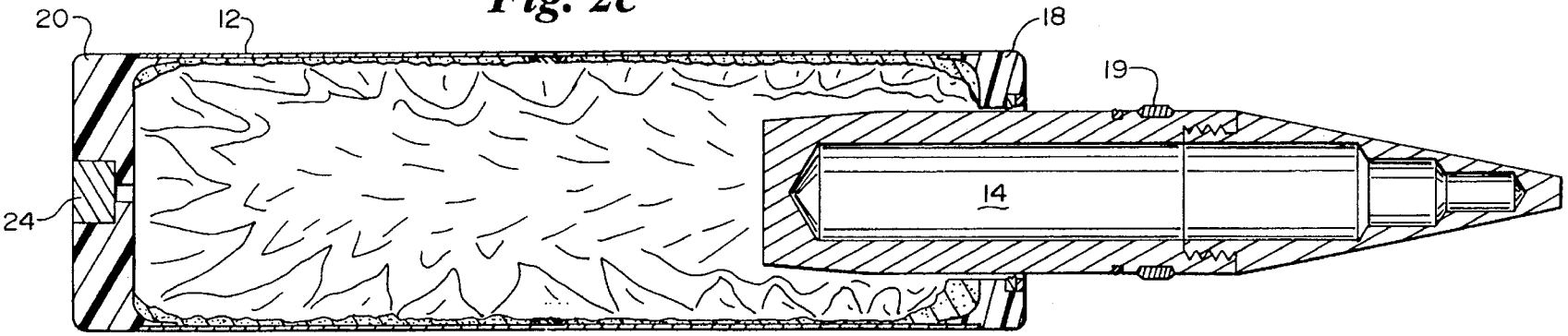

In operation, with reference to FIGS. 2*a*–2*c*, the primer 24 ignites the booster charge 26. This ignition, as shown in FIG. 2*a*, forces the projectile 14 to move from aft to forward in the case 12. The projectile 14 breaks through the environmental seal 22. The ignition of the booster charge 26 moves the projectile 14, yet the ignition of the main charge (first and second propellant 28 and 30) is delayed due to the ignition delay surface treatment 40 and the sealing ring 32. The first propellant grain 28 is not ignited immediately by the booster charge ignition. The time required to burn away the surface treatment 40 effects a delay in the ignition of the first propellant 28. The rotating band 19 limits any venting of gas or flame ahead of the projectile 14.

Referring to FIG. 2*b*, the initiation of the aft and forward propellants 28 and 30 (main propellant) is shown. The aft or first propellant 28 grain is ignited by the heat and flame of the booster charge ignition after the layer of RTV 40 has burned off. As the projectile 14 moves further out of the case 12, the gas and flame front moves past the sealing ring 32 and the second propellant 30 begins to ignite. The ignition of these two propellant segments 28 and 30 constitutes main ignition.

Referring now to FIG. 2*c*, full ignition is shown. The rotating band 19 has entered the barrel of the gun (not shown). At this point, full involvement of all propellant is desired. Combustion of the retention ring 16 and sealing ring 36 occurs at this time in the preferred embodiment. In this manner, a sequenced ignition is accomplished.

It should be understood that depending on design considerations it may be desirous to utilize an ignition delay surface treatment without the use of a propellant sealing ring or vice versa. A sequenced ignition or delayed ignition may still be accomplished under these conditions.

The above disclosure is intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A cased telescoped ammunition round, comprising:

(a) a case having a front and rear end;

(b) a projectile having aft and forward ends and carried completely within the case such that the aft end of the projectile is proximate the rear end of the case and a space is defined peripheral and aft of the projectile;

(c) a booster charge located in the space aft of the projectile;

(d) a first propellant segment located in the peripheral space between the case and the projectile, the first propellant segment having an inner surface, an aft and forward portion;

(e) a second propellant segment located in the peripheral space between the case and the projectile forward of the first propellant segment;

(f) a seal located between the first propellant and second propellant segments, the seal being generally an annular ring surrounding the projectile and having inner and outer rearwardly facing flanges; and (g) burnable ignition delay means associated with at least a portion of the inner surface of the first propellant segment and separating the first propellant segment from the booster charge and separating at least the aft portion of the first propellant segment from the projectile, whereby when the booster charge is ignited the ignition of the first propellant segment is delayed until the projectile moves a predetermined distance and the ignition delay means is burned through at least at one point and the ignition of the second propellant segment is delayed at least until the first propellant is ignited and the seal is burned through.

2. The round of claim 1 wherein the ignition delay means is a coating of RTV silicone.

3. A cased telescoped ammunition round, comprising:

(a) a case having forward and aft ends;

(b) a projectile having forward and aft portions and carried completely within the case such that a space is defined peripheral and aft of the projectile and where the aft portion of the projectile is proximate the aft end of the case;

(c) a booster charge in the space aft of the projectile;

(d) a first propellant segment located within the peripheral space between the case and the projectile and having an inner surface;

(e) a second propellant segment located within the peripheral space between the case and the projectile and forward of the first propellant segment; and (f) a seal located between the first and second propellant segments for sealing the first propellant segment from the second, the seal being a generally annular ring surrounding the projectile and having inner and outer rearwardly facing flanges, the inner flange in contact with the projectile and the outer flange in contact with the case, whereby when the booster charge is ignited the gas and flame front generated ignites the first propellant segment and the seal delays the ignition of the second propellant segment until the projectile has moved a predetermined distance.

4. The round of claim 3 further comprising combustible ignition delay means associated with the inner surface of the first propellant segment and separating the first propellant segment from the booster charge and at least the aft portion of the projectile for delaying ignition of the first propellant segment until the projectile has moved to a predetermined position.

5. The round of claim 4 wherein the ignition delay means comprises a coating of RTV silicone.

6. A cased telescoped ammunition, comprising:

(a) an outer casing having an aft and a forward portion;

(b) a projectile having an aft and a forward portion, the projectile located completely within the casing such that the aft portion of the projectile is proximate the aft portion of the casing and defining a space between the casing and the projectile and aft of the projectile;

(c) a booster charge in the space aft of the projectile;

(d) a first propellant segment located proximate the aft portion of the casing and positioned within the space between the casing and the projectile and having an inner surface;

(e) a second propellant segment located proximate the forward portion of the casing and positioned within the space between the casing and the projectile;

(f) a seal located between the first and second propellant segments for sealing the first propellant segment from the second propellant segment, the seal having a forward side and a rearward side and being generally annular and having inner and outer rearwardly facing flanges; and (g) burnable ignition delay means associated with the inner surface of the first propellant segment and the rearward side of the seal and separating the first propellant segment from the booster charge and the seal and separating the first propellant segment from at least the aft portion of the projectile whereby the ignition of the first propellant segment is delayed until the ignition delay means is burned through and the ignition of the second propellant segment is delayed until the projectile moves beyond a predetermined point in the case.

7. The ammunition of claim 6 wherein the ignition delay means comprises a coating of RTV silicone.

8. A cased telescoped ammunition round, comprising:

(a) a case having an inner surface and aft and forward portions;

(b) a first propellant segment having an inner surface and having a predetermined thickness adjacent a predetermined portion of the inner surface of the case;

(c) second propellant segment adjacent a predetermined portion of the inner surface of the case and located forward of the first propellant segment;

(d) a projectile having forward and aft ends, the projectile carried fully within the case and interior of the first propellant segment such that the aft end of the projectile is proximate the aft portion of the case and defining a space aft of the projectile;

(e) a booster charge located in the space aft of the projectile;

(f) sealing means located between the first propellant and second propellant segments, the sealing means including inner and outer rearwardly facing flanges, the inner flange adjacent the projectile and the outer flange adjacent the case;

(g) combustible ignition delay means associated with the inner surface of the first propellant segment and separating the first propellant segment from the booster charge and separating the first propellant segment from at least the aft end of the projectile, whereby when the booster charge is ignited the ignition of the first propellant segment is delayed until the ignition delay means is burned through at least at one point and the ignition of the second propellant segment is delayed until the projectile moves a predetermined distance.

9. The round of claim 8 wherein the ignition delay means is a coating of RTV silicone.

10. A cased telescoped ammunition round, comprising:

(a) a case having a front and rear end;

(b) a projectile having aft and forward ends and carried completely within the case such that the aft end of the projectile is proximate the rear end of the case and a space is defined peripheral and aft of the projectile;

(c) a booster charge located in the space aft of the projectile;

(d) a propellant segment located in the peripheral space between the case and the projectile, the propellant segment having an inner surface;

(e) a second propellant segment located in the peripheral space between the case and the projectile and forward of the propellant segment;

(f) a seal located between the propellant segment and the second propellant segment, the seal having a forward portion and an aft portion, the seal being generally annular and including inner and outer rearwardly facing flanges, the inner flange in contact with the propellant segment and the outer flange in contact with the case; and (g) a burnable coating associated with the inner surface of the propellant segment and the aft portion of the seal and separating the propellant segment from the booster charge and the seal and separating the propellant segment from at least the aft end of the projectile, whereby when the booster charge is ignited the ignition of the propellant segment is delayed until the projectile moves a predetermined distance and the coating is burned through at least at one point and the ignition of the second propellant segment is delayed until the projectile moves beyond a predetermined point in the case.

* * * * *